US010004374B2

(12) United States Patent
Schildmeier

(10) Patent No.: US 10,004,374 B2
(45) Date of Patent: Jun. 26, 2018

(54) UNITARY CLEANING FLUID AND CLEANING WIPES DEVICE

(71) Applicant: Greg Schildmeier, Santa Monica, CA (US)

(72) Inventor: Greg Schildmeier, Santa Monica, CA (US)

(73) Assignee: Gregory E. Schildmeier, Santa Monica, CA (US)

( * ) Notice: Subject to any disclaimer, the term of this patent is extended or adjusted under 35 U.S.C. 154(b) by 75 days.

(21) Appl. No.: 15/194,748

(22) Filed: Jun. 28, 2016

(65) Prior Publication Data

US 2018/0014712 A1 Jan. 18, 2018

(51) Int. Cl.

| | |
|---|---|
| ***A47L 13/16*** | (2006.01) |
| ***A47L 13/26*** | (2006.01) |
| ***A47L 13/51*** | (2006.01) |

(52) U.S. Cl.

CPC ..... *A47L 13/26* (2013.01); *A47L 13/16* (2013.01); *A47L 13/51* (2013.01)

(58) Field of Classification Search

CPC ..... A47L 13/16; A47L 13/26; A47K 10/3836
USPC ..... 206/225, 26; 222/192; 401/195; 239/289, 302, 303
See application file for complete search history.

(56) References Cited

U.S. PATENT DOCUMENTS

| | | | |
|---|---|---|---|
| 4,436,224 | A | 4/1984 | McLnerny |
| 5,671,872 | A | 9/1997 | Daniels |
| 5,819,989 | A | 10/1998 | Saraceni |
| 6,138,874 | A | 10/2000 | Audrey |
| 6,216,920 | B1 | 4/2001 | Baggett |
| 6,431,405 | B2 | 8/2002 | Irwin |
| 6,644,563 | B2 | 11/2003 | Presson |
| 7,743,847 | B2 | 6/2010 | Fisher |
| D670,115 | S | 11/2012 | Seehoff et al. |
| 8,371,479 | B2 | 2/2013 | Luft |

FOREIGN PATENT DOCUMENTS

| | | |
|---|---|---|
| WO | WO0142117 A1 | 6/2001 |

*Primary Examiner* — David Walczak
*Assistant Examiner* — Joshua Wiljanen

(57) ABSTRACT

Provided herein is a handheld cleaning device, which stores cleaning wipes as well as fluid. In an embodiment, the cleaning device comprises a hollow inner longitudinal portion, a hollow base, and a hollow outer longitudinal portion. All three hollow portions are joined together to form a single hollow fluid reservoir. In use, a cylindrical role of cleaning wipes may be slipped over the hollow inner longitudinal portion such that the hollow inner longitudinal portion is located inside the cylindrical roll of the cleaning wipes. The hollow outer longitudinal portion is located outside the cylindrical roll of the cleaning wipes and secures the cylindrical roll of cleaning wipes to the device. Further, the hollow base is located under the cylindrical roll of the cleaning wipes and further secures the cylindrical roll of cleaning wipes to the device.

14 Claims, 6 Drawing Sheets

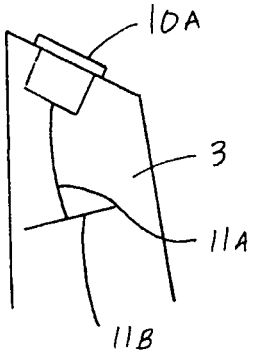
Fig 5A
Fig 5B
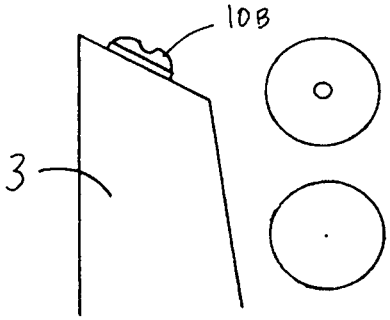
Fig 5C
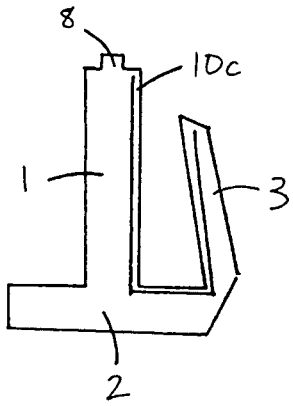

UNITARY CLEANING FLUID AND CLEANING WIPES DEVICE

FIELD

Embodiments of the present invention involve devices for storing and dispensing cleaning fluid and cleaning wipes

BACKGROUND

Conventionally, cleaning fluid storage and dispensing devices are separate from cleaning wipes storage and dispensing devices. As such, the user is forced to carry two separate devices while cleaning, which is cumbersome and frustrating. Thus, the desire to combine the two devices into a single device was born.

For example, U.S. Pat. No. 6,644,563 (filed on Dec. 26, 2000) discloses a two in one cleaning tool that stores cleaning fluid in a fluid reservoir that extends through the center of a paper towel roll. The top of the cleaning device includes a sprayer that dispenses cleaning fluid when squeezed. While the cleaning tool reduced cumbersomeness by combining the previous two devices into one, the cleaning tool remained frustrating because the fluid reservoir was too small and stored an insufficient amount of fluid. The fluid reservoir was necessarily thin because the structure needed to fit inside a roll of paper towels. However, the thin structure caused the reservoir's volume to be so small, users were constantly having to refill the device during a single cleaning session and were forced to maintain a separate fluid storing device for use in refilling the thin reservoir. As such, the user still required two devices: the cleaning tool and a backup fluid storage vessel. Further still, the device was frustrating because it needed to be refilled constantly. That being said, the inventor's attempt to solve the volume deficiency problem by increasing the fluid reservoir capacity above the paper towels simply caused more problems. For example, the proposed design caused the device to be too tall for typical storage locations (e.g., on a countertop under the cabinets, inside cabinets, on a pantry shelf, on a store display shelf, etc.). Moreover, the device comprised several small and complicated moving pieces that made the device difficult to manufacture and are easily breakable during shipping and use.

In another examples, U.S. Pat. No. 8,371,479 (filed on Aug. 18, 2009), U.S. Pat. No. 6,138,874 (filed Nov. 29, 1999), U.S. Pat. No. D670,115 S (filed Feb. 11, 2012), and U.S. Pat. No. 6,216,920 (filed Dec. 6, 1999) likewise disclose a two in one cleaning tool that stores cleaning fluid in a fluid reservoir that extends through the center of a paper towel roll. However, the device shares many of the same problems as the device described above. The fluid reservoir is limited in volume because the structure is restricted to the center of the paper towel roll. The overall height of the devices is too tall; and further, the devices also include several small and complicated moving pieces making them difficult to manufacture, ship, and use.

U.S. Pat. No. 5,819,989 (filed Jul. 17, 1997), U.S. Pat. No. 5,671,872 (filed Apr. 26, 1996), and U.S. Pat. No. 4,436,224 (filed Mar. 13, 1984) disclose a structure similar to those described above. However, the cleaning device increased the fluid reservoir capacity by extending the reservoir into the base of the device. While increasing the fluid reservoir capacity was helpful, the increase was not sufficient. The fluid reservoir still stored a frustratingly low volume of fluid. Further, the devices include features, which were an inefficient use of materials. For example, the device of the '989 patent includes actuate retainers 42 and 52, whose only purpose is to prevent the paper towels from unraveling. The actuate retainers do not increase the volume of the fluid reservoir and add unnecessary weight to the device, making the device expensive to manufacture, ship, and difficult to use for an extended period of time.

U.S. Pat. No. 6,431,405 (filed Aug. 13, 2002) and WO 01/42117 A1 (filed Dec. 12, 2000) likewise discloses a structure similar to those described above. However, the cleaning device attempts to increase the fluid reservoir capacity by extending the reservoir upwards above the paper towels. The design is insufficient because the reservoir fails to extend all the way down the center of the paper towels, thereby wasting valuable fluid storage real estate. Further, the design seems to operate with proprietary cleaning wipes and lacks versatility. One would not be able to use the cleaning device with a generic paper towel roll which would be frustrating to consumers wanting to retrofit the cleaning device with traditional paper towels.

As such, a device which increases the volume capacity of the fluid reservoir and minimizes features that are complicated, small, breakable, and/or add unnecessary weight to the device is desired. Moreover, it would be further desirable that the device is self-standing, of minimal size for easy storage and shipping, and simple to carry without hurting the user's hand. Further still, it would be desirable if the device was compatible with generic and/or traditional cleaning wipes.

SUMMARY

In light of the above, a handheld cleaning device is developed, which stores cleaning wipes as well as fluid. In an embodiment, the cleaning device comprises a hollow inner longitudinal portion, a hollow base, and a hollow outer longitudinal portion. All three hollow portions are joined together to form a single hollow fluid reservoir. In use, a cylindrical role of cleaning wipes may be slipped over the hollow inner longitudinal portion such that the hollow inner longitudinal portion is located inside the cylindrical roll of the cleaning wipes. The hollow outer longitudinal portion is located outside the cylindrical roll of the cleaning wipes and secures the cylindrical roll of cleaning wipes to the device. Further, the hollow base is located under the cylindrical roll of the cleaning wipes and further secures the cylindrical roll of cleaning wipes to the device. The cleaning device also has a handle which includes a spraying apparatus. When the spraying apparatus is actuated, sprays liquid from the fluid reservoir.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

FIG. 5A illustrates an example close-up view of an embodiment of the outer longitudinal portion;

FIG. 5B illustrates an example close-up view of an embodiment of the outer longitudinal portion; and FIG. 5C illustrates an example close-up view of an embodiment of the outer longitudinal portion;

DETAILED DESCRIPTION

The detailed description set forth below, in connection with the appended drawings, is intended as a description of various configurations and is not intended to limit the scope of the disclosure. Rather, the detailed description includes specific details for the purpose of providing a thorough understanding of the inventive subject matter. It will be apparent to those skilled in the art that these specific details are not required in every case and that, in some instances, well-known structures and components are shown in block diagram form for clarity of presentation.

Figure 1A:
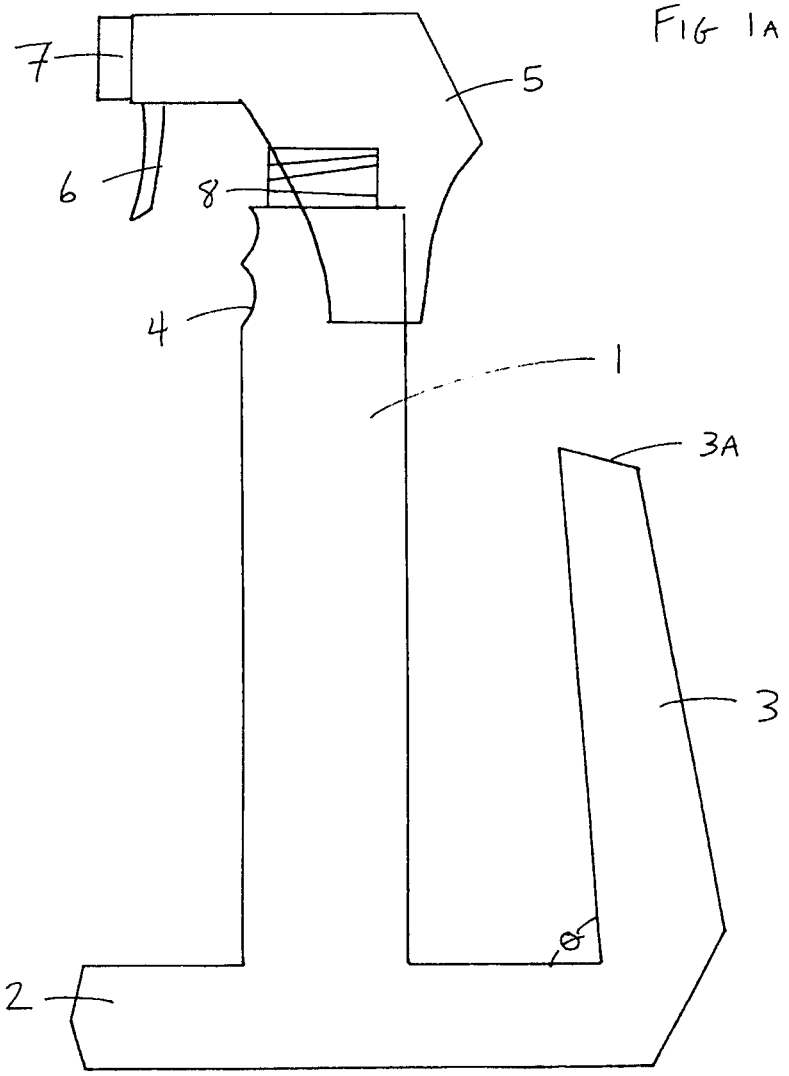
FIG. 1A illustrates an example side view of an embodiment of the device wherein example cleaning wipes are not attached.
Figure 1B:
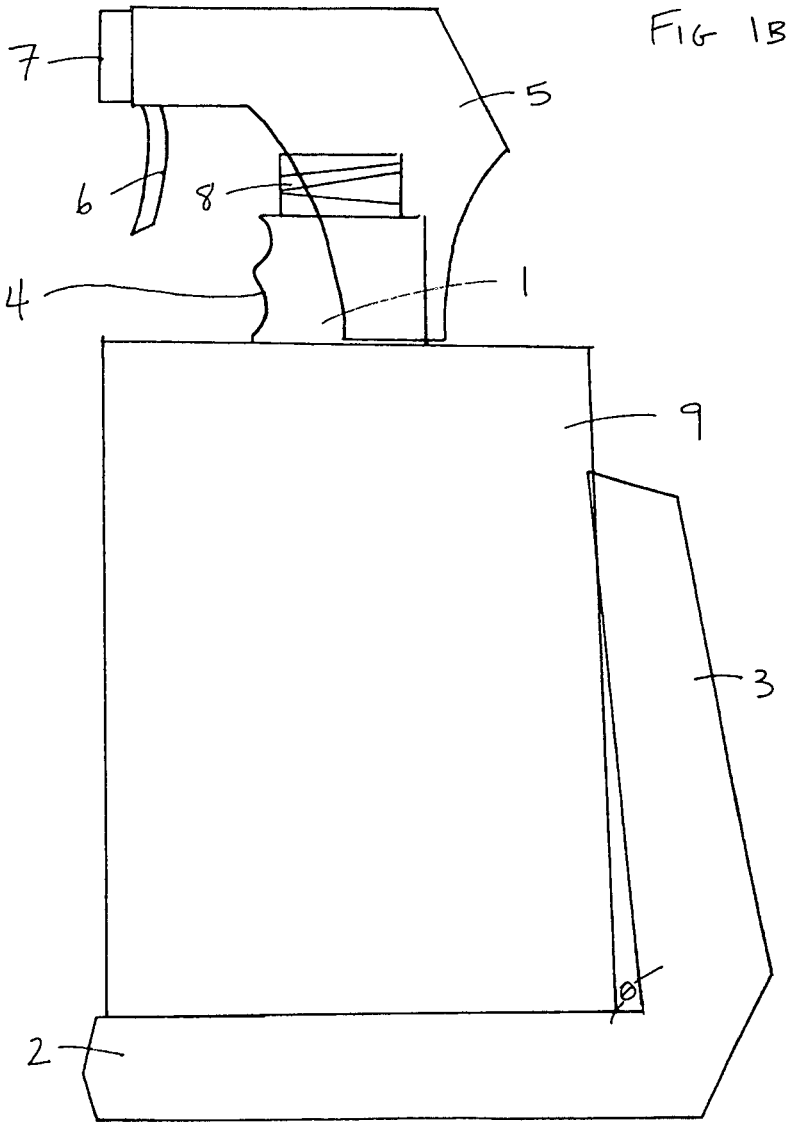
FIG. 1B illustrates an example side view of an embodiment of the device wherein example cleaning wipes are attached.

FIGS. 1A and 1B illustrate an example side view of an embodiment of the device. The handheld cleaning device 100 is a single device operable to store and dispense both cleaning wipes and fluid. The device 100 includes a hollow inner longitudinal portion 1. The hollow inner longitudinal portion 1 may be shaped to receive cleaning wipes 9 there-around. For example, hollow inner longitudinal portion 1 may be tall, narrow, and round, such that a roll of generic paper towels can be slipped around hollow inner longitudinal portion 1. Of course, hollow inner longitudinal portion 1 may be shaped to accommodate any size and shape of disposable cleaning wipes 9 (proprietary or not). Coupled to the bottom of hollow inner longitudinal portion 1 is hollow base 2, which is sized to accommodate cleaning wipes 9. For example, hollow base 2 may be shaped such that a roll of paper towels rests on the hollow base 2. In embodiments, hollow base 2 may be square, circular, elongated, narrow, angled, and/or any combination thereof, and the like. In embodiments, hollow base 2 is narrow and elongated such that hollow base 2 provides sufficient balance or and allows the device 100 to remain upright while not being held. Further, hollow base 2 may be sized sufficiently large to increase the volume of fluid storage within hollow base 2. Nonetheless, the size of hollow base 2 may be minimized in order to reduce the space need to store and/or ship the device. As such, the size, thickness, weight, and volume storage of hollow base 2 is determined based at least on the above mentioned factors.

Connected to hollow base 2 is hollow outer longitudinal portion 3. Hollow outer longitudinal portion 3 extends upwards from hollow base 2. Hollow outer longitudinal portion 3 is shorter than hollow inner longitudinal portion 1. Said another way, hollow inner longitudinal portion 1 extends upwards from hollow base 2 to a height of x, while hollow outer longitudinal portion 3 extends upwards from hollow base 2 to a height of y, wherein: $y<x$. The height differential between hollow inner longitudinal portion 1 and hollow outer longitudinal portion 3 aids in filling the fluid reservoir to its full capacity.

Hollow outer longitudinal portion 3 may secure cleaning wipes 9 to the device 100. In embodiments, hollow outer longitudinal portion 3 extends perpendicularly upwards from hollow base 2. Alternatively, hollow outer longitudinal portion 3 extends upwards from hollow base 2 at an obtuse or acute angle θ. The angle of hollow outer longitudinal portion 3 may assist in securing the cleaning wipes 9. For example, when the angle is acute, hollow outer longitudinal portion 3 slants inwards towards the cleaning wipes 9 such that portions of hollow outer longitudinal portion 3 press the cleaning wipes 9 towards hollow inner longitudinal portion 1. Pressing the cleaning wipes 9 towards hollow inner longitudinal portion 1 secures the cleaning wipes 9 in place. This may prevent the cleaning wipes 9 from unexpectedly unraveling or unexpectedly slipping off the device 100.

Hollow inner longitudinal portion 1, hollow base 2, and hollow outer longitudinal portion 3 may be joined together to form a unitary handheld structure. The exterior of the unitary handheld structure has a solid, waterproof exterior. The interior of the unitary handheld structure makes up a single fluid reservoir interior. Alternatively, the structure may be non-unitary, in that one or more of hollow inner longitudinal portion 1, hollow base 2, and hollow outer longitudinal portion 3 are joined together at joints using a coupling mechanism (e.g., adhesive, threads, screwing mechanism, seals, snaps, waterproof zips, etc., and the like, and/or any combination thereof). The unitary handheld structure may be formed of plastic, metal, wood, recyclables, any combination thereof, and/or the like. The size, shape, thickness, and weight of any of hollow inner longitudinal portion 1, hollow base 2, and hollow outer longitudinal portion 3 may be adjusted to increase the volume of the fluid reservoir and/or decrease the space needed to store and ship the device 100. The thickness of the material forming the unitary handheld structure may also be adjusted control the weight of the device 100 while empty. The unitary handheld structure may be designed to have a weight and/or balance allowing the device 100 to stand alone with or without fluid stored therein. The single handheld structure may be designed to reduce the weight of the structure such that the user can hold it with ease, and/or the device 100 may be shipped and stored at a reduced cost. As such, various portions of hollow inner longitudinal portion 1, hollow base 2, and hollow outer longitudinal portion 3 may have varying weights and/or balance such that structure is light weight yet also capable of being self-standing.

The interior of the unitary handheld structure is hollow and adapted to receive, store, and dispense fluid. The fluid may be cleaning solution, water, bug spray, weed killer, paint, solvent, acid, any combination thereof, and/or the like. The hollow base 2 is hollow such that the volume of the fluid reservoir is increased and device 100 is more stable (e.g., able to self-stand). Hollow outer longitudinal portion 3 is hollow such that the volume of the fluid reservoir is increased, device 100 is more stable (e.g., able to self-stand), and the cleaning wipes are supported.

The upper portion of hollow inner longitudinal portion 1 may comprise handle 4. Of course, handle 4 may be an integral portion of inner longitudinal portion 1 or may be coupled thereto using a coupling mechanism. In an embodiment, handle 4 comprises grips making it easier for a user to grasp the handle and hold the device. In embodiments, handle 4 is ergonomic. Above handle 4 is joining device 8. Of course, joining device 8 may be an integral portion of handle 4 or may be coupled thereto via a coupling mechanism. In embodiments, joining device 8 may be threaded, have snaps, be nested, and/or otherwise receive a fixture to be attached thereto. In embodiments, handle 4 and/or joining device 8 are hollow and add additional volume to the fluid reservoir.

Spraying mechanism 5 couples to handle 4 via joining device 8. In an embodiment, spraying mechanism 5 comprises grips making it easier for a user to grasp and hold the device. In embodiments, spraying mechanism 5 is ergonomic. In embodiments, spraying mechanism 5 includes an actuator 6 (e.g., hand trigger) and nozzle 7. In an example operation, a user sprays cleaning fluid from the fluid reservoir by squeezing the actuator 6 using his hand. Upon the user squeezing actuator 6, fluid is drawn up the fluid reservoir (e.g., through a straw, not shown), and sprayed out the nozzle 7.

Figure 2:
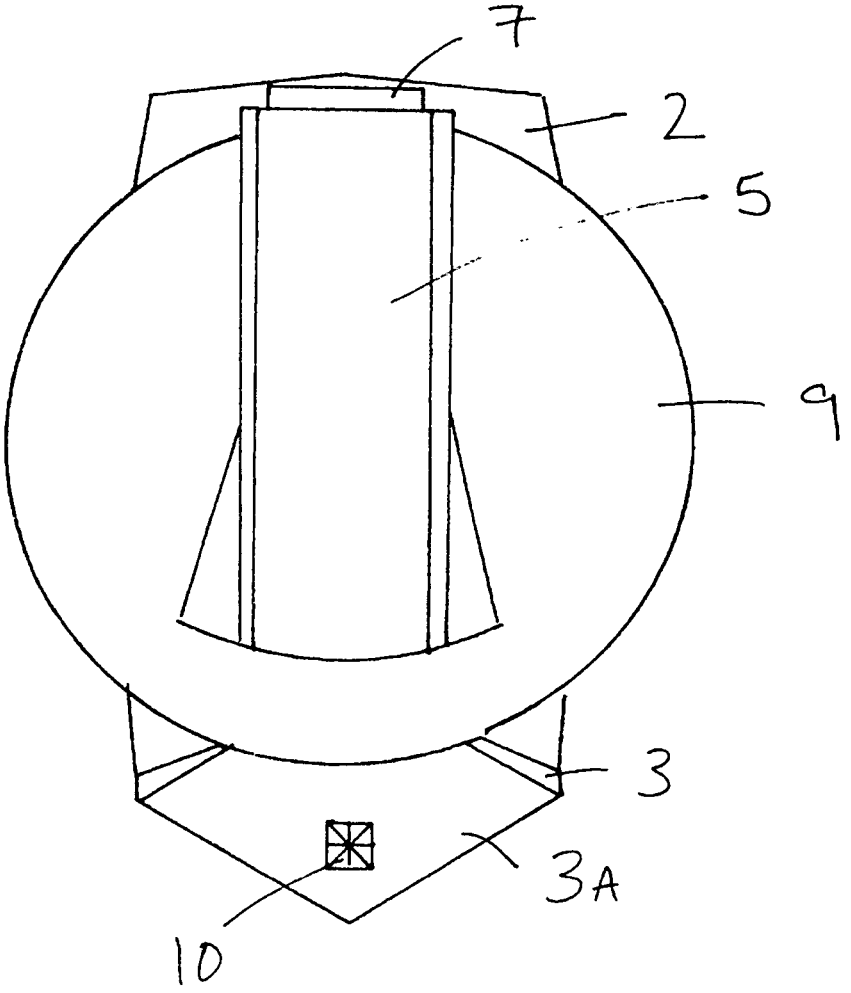
FIG. 2 illustrates an example top view of an embodiment of the device.

FIG. 2 illustrates an example top view of an embodiment of the device. From this angle, one can see the ergonomic shape of spraying mechanism 5. Further, one can see that nozzle 7 is attached to a distal end of spraying mechanism 5. This view shows the top portion of cleaning wipes 9, which in this example is a roll of paper towels. Hollow base 2 is shown as extending outwardly from cleaning wipes 9. Hollow base 2's shape and size support cleaning wipes 9 and stabilizes device 100 such that it is self-standing. Hollow outer longitudinal portion 3 is shown extending up from hollow base 2 and is pressing against cleaning wipes 9 thereby securing cleaning wipes 9 in place.

Figure 3:
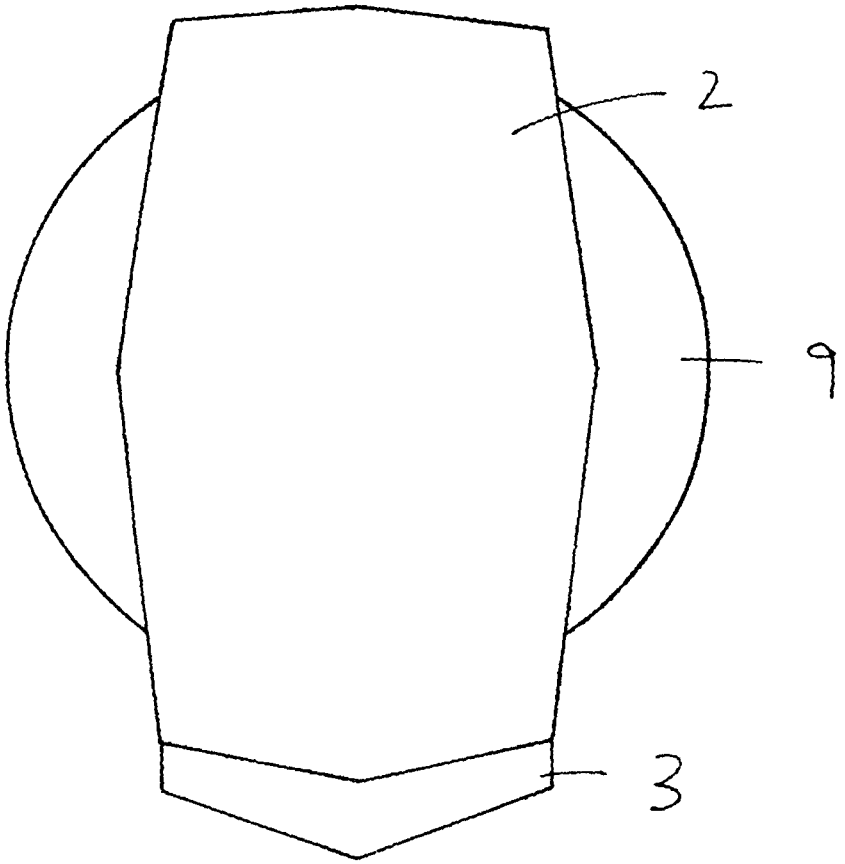
FIG. 3 illustrates an example bottom view of an embodiment of the device.

FIG. 3 illustrates an example bottom view of an embodiment of the device. From this angle, one can view an example shape of hollow base 2. Hollow base 2 extends outwardly from cleaning wipes 9 in some directions but does not extend outwardly from cleaning wipes 9 in other directions. In this embodiment, hollow base 2 extends outwardly from cleaning wipes 9 in two directions but does not extend outwardly from cleaning wipes 9 in two other directions. Hollow outer longitudinal portion 3 is shown extending up from hollow base 2 and is pressing against cleaning wipes 9 thereby securing cleaning wipes 9 in place.

Figure 4:
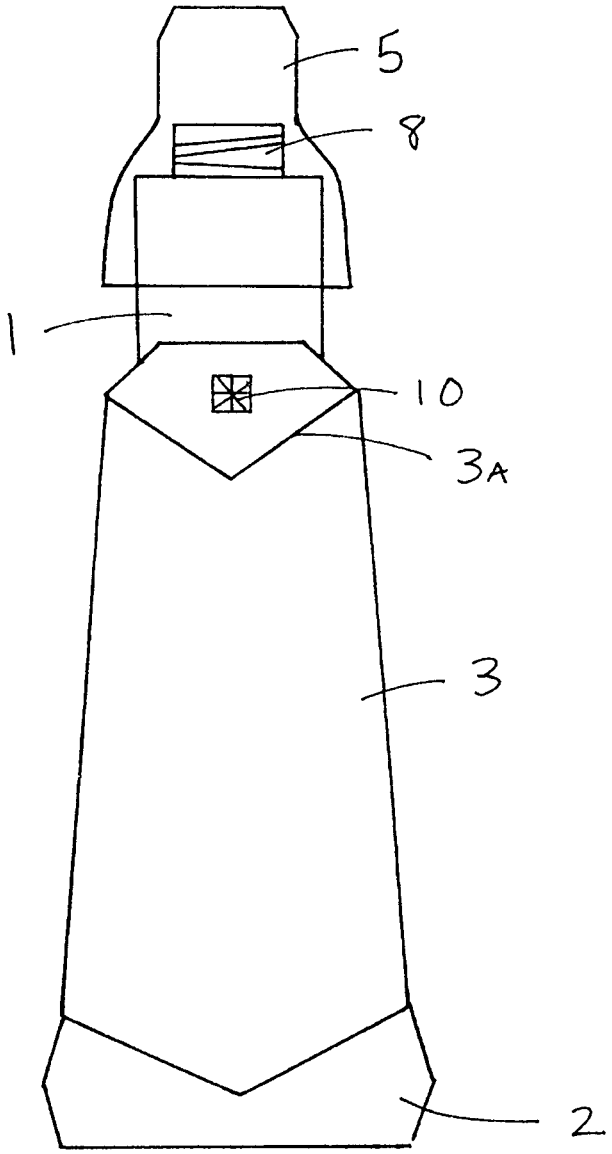
FIG. 4 illustrates an example rear view of an embodiment of the device.

FIG. 4 illustrates an example rear view of an embodiment of the device. This example illustration excludes cleaning wipes 9 to make device 100 easier to view. From this angle, one can see the ergonomic shape of spraying mechanism 5 and an example attachment of spraying mechanism 5 to hollow inner longitudinal portion 1 via joining device 8. Hollow base 2 is shown coupled to hollow outer longitudinal portion 3, which extends upwardly therefrom. This view illustrates the top most portion 3*a* of hollow outer longitudinal portion 3, which may comprise pressure balancing mechanism 10. Pressure balancing mechanism 10 increases the amount of fluid stored within the total fluid reservoir by maximizing the amount of fluid stored within hollow outer longitudinal portion 3.

When filling the fluid reservoir, a user may remove spraying mechanism 5 from handle 4 via joining device 8, for example by unscrewing the spraying mechanism 5. With spraying mechanism 5 removed, the interior of the fluid reservoir is accessible via an opening at the top of joining device 8. In a filling operation, a user pours liquid into the fluid reservoir through the opening at the top of hollow inner longitudinal portion 1. The fluid will flow down hollow inner longitudinal portion 1 and fill hollow base 2. Once hollow base 2 is filled with fluid, the fluid will start filling hollow inner longitudinal portion 1 and hollow outer longitudinal portion 3. However, if hollow outer longitudinal portion 3 has no pressure balancing mechanism through which air can escape, pressure will increase at the top of hollow outer longitudinal portion 3 as fluid is added to the fluid reservoir. At some point during the filling operation, the air pressure at the top of hollow outer longitudinal portion 3 which reach a threshold level, and hollow outer longitudinal portion 3 will be unable to receive any additional fluid even though there appears to be additional space in hollow outer longitudinal portion 3 that could potentially receive fluid. Because of this pressure problem, in some situations, hollow outer longitudinal portion 3 may be limited to receiving merely a percentage of the full fluid capacity due to a pressure build-up resulting from air being trapped in this extended area (e.g., merely 20%, 30%, 40%, 50%, etc. of fluid capacity). As such, embodiments herein include a pressure balancing mechanism 10, which solves the air pressure problem and allows the fluid reservoir to be filled to capacity with fluid.

FIG. 5A illustrates an example close-up view of an embodiment of hollow outer longitudinal portion 3 and pressure balancing mechanism 10*a*. In embodiments, pressure balancing mechanism 10*a* is a plug, which is removeably insertable into an opening of hollow outer longitudinal portion 3. The plug may comprise a security tail, which may have a vertical proximal portion 11A allowing the plug to lift away from the opening while having a horizontal distal portion 11B preventing the plug from being completely disengaged from the opening. When the plug is removed, the opening releases air pressure from the hollow outer longitudinal portion 3. Release of the air pressure allows the fluid to completely fill the entire fluid reservoir including all of hollow inner longitudinal portion 1, all of hollow base 2, and all of hollow outer longitudinal portion 3.

In this particular embodiment, having a plug that allows for the air to escape the fluid reservoir during the filling process allows hollow outer longitudinal portion 3 to fill at the same rate as hollow inner longitudinal portion 1. As such, once hollow base 2 is filled with fluid, the fluid will start filling hollow inner longitudinal portion 1 and hollow outer longitudinal portion 3 at the same or similar rate. Due to hollow outer longitudinal portion 3 having pressure balancing mechanism 10A (e.g., plug) through which air can escape, fluid is able to fill to the top of hollow outer longitudinal portion 3 as fluid is added to the fluid reservoir. Because hollow inner longitudinal portion 1 is taller than hollow outer longitudinal portion 3, hollow outer longitudinal portion 3 will be completely filled before the top most portions of hollow inner longitudinal portion 1 is filled. In operation, once hollow outer longitudinal portion 3 is full, the plug can be reinserted thereby closing the opening, and the remaining portion of hollow inner longitudinal portion 1 to be topped off with fluid.

FIG. 5B illustrates an example close-up view of an embodiment of the hollow outer longitudinal portion 3 and pressure balancing mechanism 10B. In embodiments, fluid controller 10B is a nipple. When the nipple is depressed, the nipple allows air to escape, which balances the pressure between hollow inner longitudinal portion 1 and hollow outer longitudinal portion 3. Because the air pressure is balanced, hollow outer longitudinal portion 3 fills at the same or similar rate as hollow inner longitudinal portion 1. Further, since hollow inner longitudinal portion 1 is taller than hollow outer longitudinal portion 3, hollow outer longitudinal portion 3 will be completely filled before the final portions of hollow inner longitudinal portion 1 are filled. In operation, once hollow outer longitudinal portion 3 is full, the nipple 10B can be released, thereby sealing off the opening and allowing for the remaining portion of hollow inner longitudinal portion 1 to be topped off with fluid.

FIG. 5C illustrates an example close-up view of an embodiment of the hollow outer longitudinal portion 3 and pressure balancing mechanism 10C. In embodiments, fluid controller 10C may be a valve, air tubing, or a manufactured space such as a borehole or plastic divider that displaces air in favor of fluid. During a filling operation, the valve allows for air to escape from the top of hollow outer longitudinal portion 3 and out of the opening at the top of hollow inner longitudinal portion 1, thereby balancing the air pressure of the two chambers as explained above. Because hollow inner longitudinal portion 1 is taller than hollow outer longitudinal portion 3, hollow outer longitudinal portion 3 will be completely filled before the final portions of hollow inner longitudinal portion 1 are filled. As such, once hollow outer longitudinal portion 3 is filled, the user may continue to top off hollow inner longitudinal portion 1 with more fluid.

Once the entire fluid reservoir is filled, the fluid reservoir may be closed using spraying mechanism 5. With the device 100 filled with fluid, the user can spray fluid and use the cleaning wipes 9 as desired.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C) or any of these in any combination thereof.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed is:

1. A cleaning device comprising:

a hollow inner longitudinal portion;

a hollow base;

a hollow outer longitudinal portion; and a handle, wherein the hollow inner longitudinal portion couples to the hollow base and wherein the hollow base couples to the outer longitudinal portion, thereby forming a single hollow fluid reservoir, wherein the hollow inner longitudinal portion extends longitudinally further from the hollow base as compared to the hollow outer longitudinal portion, wherein the cleaning device is adapted to store cleaning wipes that are attached to a cylindrical roll, wherein the hollow inner longitudinal portion is located inside the cylindrical roll of the cleaning wipes, the hollow outer longitudinal portion is located outside the cylindrical roll of the cleaning wipes, and the hollow base is located under the cylindrical roll of the cleaning wipes, wherein the hollow outer longitudinal portion comprises a pressure balancing mechanism operable to fill the hollow outer longitudinal portion with fluid, and wherein the handle couples to the hollow inner longitudinal portion and the handle comprises a spray mechanism operable to spray fluid from the fluid reservoir.

2. The cleaning device of claim 1 wherein the hollow outer longitudinal portion does not directly contact the hollow inner longitudinal portion, but rather, the hollow outer longitudinal portion is coupled to the hollow inner longitudinal portion via the hollow base.

3. The cleaning device of claim 1 wherein the hollow outer longitudinal portion angles inward towards the hollow inner longitudinal portion.

4. The cleaning device of claim 3 wherein the angled hollow outer longitudinal portion secures the cleaning wipes.

5. The cleaning device of claim 1 wherein the pressure balancing mechanism comprises a nipple.

6. The cleaning device of claim 1 wherein the pressure balancing mechanism comprises pressure valve.

7. The cleaning device of claim 1 wherein the pressure balancing mechanism comprises a plug that fits into an opening of the hollow outer longitudinal portion securing the cleaning wipes.

8. The cleaning device of claim 1 wherein the pressure balancing mechanism is a borehole.

9. The cleaning device of claim 1 wherein a first horizontal length of the hollow base is longer than a second horizontal length of the hollow base.

10. The cleaning device of claim 9 wherein the hollow base is rectangular shaped or oval shaped.

11. The cleaning device of claim 1 wherein the fluid reservoir extends upwardly into the handle.

12. The cleaning device of claim 1 wherein the handle couples to the hollow inner longitudinal portion via a screw mechanism.

13. The cleaning device of claim 1 wherein a base of the handle is wider than the cylindrical roll of the cleaning wipes.

14. The cleaning device of claim 1 wherein the cylindrical roll of the cleaning wipes is coupled to the device by sliding the cylindrical roll of the cleaning wipes on to the hollow inner longitudinal portion such that the cylindrical roll of the cleaning wipes rests on the hollow base and thereafter the handle is coupled to the hollow inner longitudinal portion.

* * * * *